US005662386A

United States Patent [19]

Newman et al.

[11] Patent Number: 5,662,386

[45] Date of Patent: Sep. 2, 1997

[54] PLUNGER-ACTUATED SURFACE-TREATING DEVICES

[76] Inventors: Christopher M. Newman; Clifford W. Newman, both of 310 N. Myrtle St., Glenwood, Iowa 51534

[21] Appl. No.: 550,599

[22] Filed: Oct. 31, 1995

[51] Int. Cl.[6] ..... B25D 1/12; B25D 17/06

[52] U.S. Cl. ..... 299/37.5; 125/40; 173/90; 299/100

[58] Field of Search ..... 299/37.3, 37.4, 299/37.5, 100; 172/21; 111/96, 106, 115; 175/19; 173/90; 125/40, 43

[56] References Cited

U.S. PATENT DOCUMENTS

| | | | |
|---|---|---|---|
| 2,147,828 | 2/1939 | Daniels | 173/90 X |
| 2,619,832 | 12/1952 | Vermeiden | 175/19 X |
| 3,036,482 | 5/1962 | Kenworthy et al. | 173/90 |
| 3,565,351 | 2/1971 | Ross, Jr. | 299/100 X |
| 4,241,795 | 12/1980 | Landry, Jr. | 173/90 |

FOREIGN PATENT DOCUMENTS

| | | | |
|---|---|---|---|
| 1777246 | 1/1978 | Germany | 125/40 |

*Primary Examiner*—David J. Bagnell
*Attorney, Agent, or Firm*—George R. Nimmer

[57] ABSTRACT

Plunger-actuated surface-treating devices adapted for dislodging ice, linoleum, floor-tiles, carpets, and other topical-surfaces from underlying substrates. Several components of the disclosed plunger-actuated surface-treating devices respectively extend along an uprightable central-axis and include: a metallic surface-impacting tool at the lower-end forward-extremity of a rearwardly tubular forward-part having a topical rearward-end which tightly tubularly enclosed a non-metallic plug having a rearward topical-end; a semi-resilient non-metallic tubular rearward-part maintained in a preferably visually-concealed spatial-gap rearward overlying condition to the rearwardly tubular forward-part; a shock-absorber member loosely associated within the rearwardly tubular forward-part immediately rearwardly above the tightly enclosed non-metallic plug; and a manually-actuatable plunger having a forward and lower aft-end immediately overlyingly confronting the shock-absorber member and having a manually-thrustable upper and rearward trail-end located loftily upwardly rearwardly of the non-metallic tubular rearward-part.

3 Claims, 1 Drawing Sheet

PLUNGER-ACTUATED SURFACE-TREATING DEVICES

BACKGROUND OF THE INVENTION

As typified by prior art U.S. Pat. No. : 2,057,142 (Fry—Oct. 13, 1936); U.S. Pat. No. 2,738,580 (Rice—Mar. 20, 1956); U.S. Pat. No. 2,855,668 (Ottenad—Oct. 14, 1958); and U.S. Pat. No. 3,830,310 (Williams—Aug. 20, 1974): plunger-actuated surface-treating devices extending along an upright longitudinally extending central-axis and having a downwardly thrustable plunger member toward a lower-end surface-impacting tool are suggested in prior art teachings. However, such prior art plunger-actuated surface-treating devices are fraught with several disadvantages and deficiencies such as, but not limited to: are not structurally adaptable to efficiently dislodge variously randomly encountered topical-surfaces from their underlying substrates; are operationally unreliable for their intended purposes; are too heavy to be conveniently and reliably operated by variously physically endowed persons for the surface-treating intended purposes; and are not economically acquirable nor maintainable by the intended operational population.

GENERAL OBJECTIVE OF THE INVENTION

It is accordingly the general objective of the present invention to provide improved "plunger-actuated surface-treating devices" having a selectable lower-end surface-impacting tool for dislodging topical-surfaces from underlying substrates and which surface-treating device overcomes the disadvantages and deficiencies fraught by prior art plunger-actuated surface-treating devices, and which disadvantages and deficiencies have been recited immediately hereabove.

GENERAL STATEMENT OF THE INVENTION

In view of the foregoing, the general objective of the present invention is accomplished by providing "plunger-actuated surface-treating devices" of the present invention extend along an uprightable and longitudinally extending central-axis and comprise: a metallic surface-impacting tool at the lower-end forward-extremity of a rearwardly tubular forward-part having a topical rearward-end and which rearwardly tubular portion tightly tubularly encloses a non-metallic plug having an upper and rearward topical-end; a semi-resilient non-metallic tubular rearward-part maintained in a preferably visually-concealed spatial-gap upper and rearward overlying condition to the topical rearward-end of the tubular forward-part; a preferably metallic shock-absorber member loosely associated within the rearwardly tubular forward-part immediately above the said tightly enclosed non-metallic plug; and a manually-actuatable plunger having a forward and lower aft-end immediately overlyingly confronting the shock-absorber member and having a downwardly manually-thrustable upper and rearward trail-end permanently located loftily above in reciprocatable relationship of the surrounding non-metallic tubular rearward-part.

BRIEF DESCRIPTION OF THE DRAWING

In the drawing, wherein like characters refer to like parts in the several views, and in which.

DETAILED DESCRIPTION OF THE DRAWING

Figure 2:
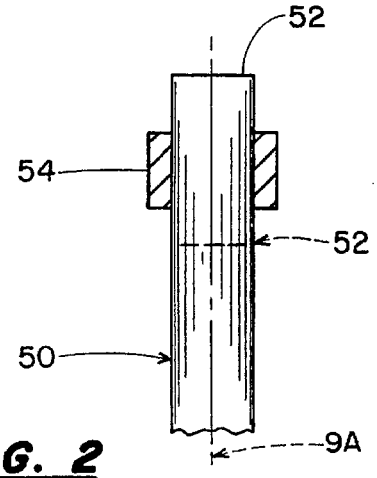
FIG. 2 is a sectional elevational view taken along lines 2—2 of FIG. 1 and 3.
Figure 3:
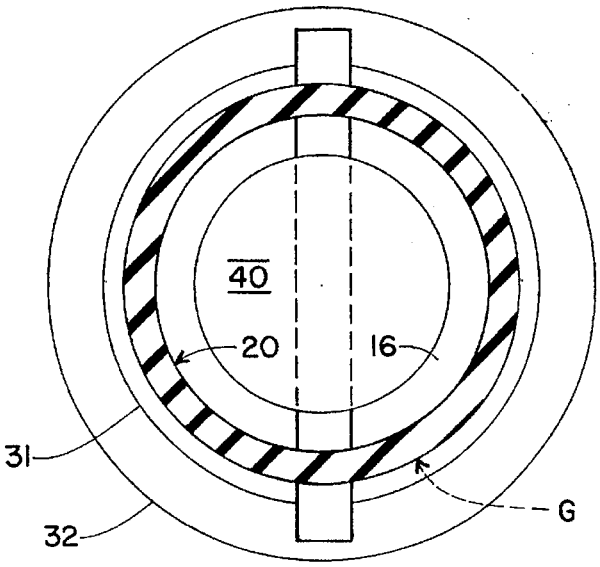
FIG. 3 is a sectional plan view taken along line 3—3 of FIG. 2.
Figure 1:
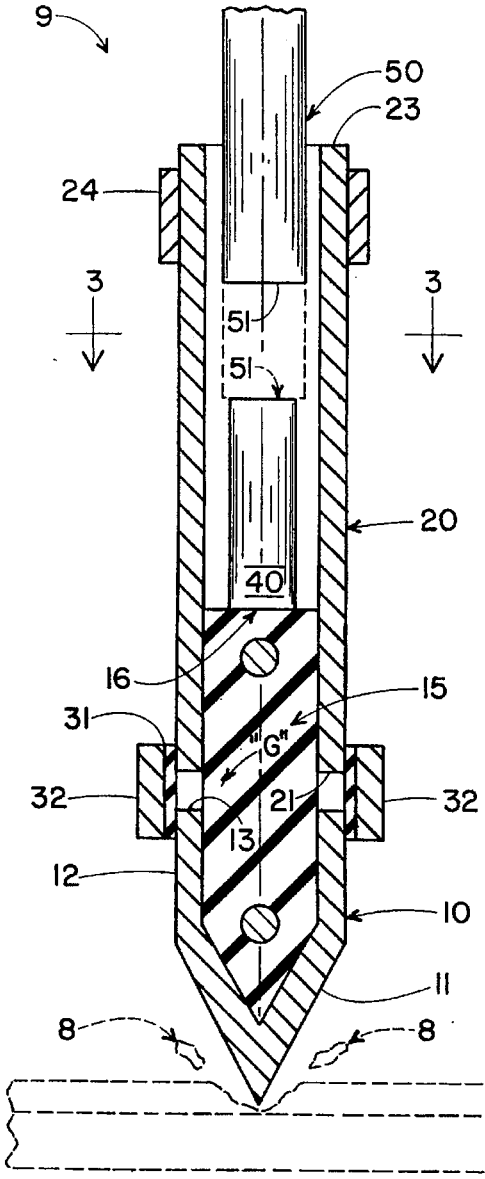
FIG. 1 is a side elevational view of a representative embodiment of the "plunger-actuated surface-treating devices" of the present invention.
Figure 1:
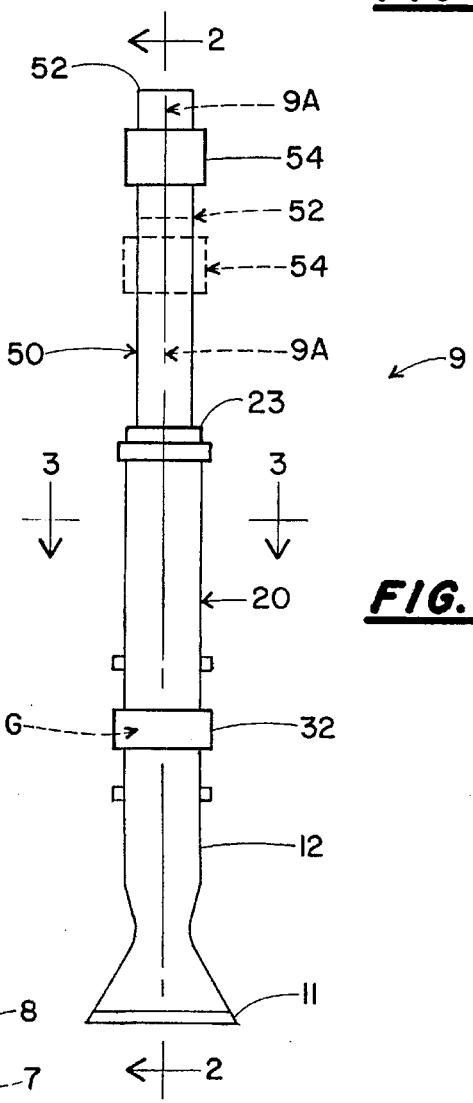

Representative embodiment 9 of the "plunger-actuated surface-treating devices" of the present invention is uprightably manually initiatably extendable along a longitudinal central-axis 9A and thence surroundably comprises along central-axis 9A; a metallic surface-impacting tool 11 (for dislodging topical-surfaces 8 from underlying substrates 7) located at the lower-end forward-extremity of a rearwardly tubular (12) metallic forward-part 10 having a topical rearward-end 13 and which rearwardly tubular tightly surroundingly embraces a wooden or otherwise preferably non-metallic plug 15 having a topical-end 16; a semi-resilient (e.g. fiberglass) non-metallic tubular rearward-part 20 having a lower and forwardmost-end 21 located a finite-gap "G" above the forward-part topical rearward-end 13 and an upper rearmost-end 23 circumferentially provided with a manually-graspable forward-part-handle 24; means for spatially maintaining such finite-gap "G", such as a preferably visually-opaque sturdy tape-strip 32 adhesively attached (31) to the upper (13) and lower (21) extremities of such forward-part (10) and rearward-part (20), respectively; a preferably metallic and cylindrical shock-absorber member 40 loosely associated within the rearwardly tubular (12) forward-part 10 immediately resting upon a such non-metallic plug 15; and a manually-actuatable and longitudinally-reciprocatable plunger 50 having a lower forward aft-end 51 immediately overlyingly confronting the shock-absorber member (40) and having an upper and rearward trail-end 52 permanently located loftily above the surrounding non-metallic tubular rearward-part 20 and circumferentially upwardly equipped with a manually-graspable rearward-part-handle 54.

Accordingly, it will become readily seen that operation of the said representative embodiment 9 for dislodging encountered topical-surfaces 8 from their underlying substrates 7 will occur, as follows:

as an operator for such representative(9) "plunger actuated surface treating tool", standing upon a sought dislodgable topical-surface (8), topically wields a such representative device(9), and with one-hand topically-grasping(24) tubular rearward-part (20), and with the other hand topically-grasping (54) a said plunger 50: forwardmost-part surface-impacting tool 11 is periodically downwardly-thrustably initiated against the dislodgable topical-surface (8) and at each such periodic downward initiation (indicated in phantom lines),the such periodic initiation (indicated in drawing phantom lines from upward-condition solid lines) will thusly periodically reciprocatably dislodge portions (8), during such periodic reciprocations of plunger member 50 toward surface-impacting tool 11 carried by the forward-part 10.

In view of the foregoing, the construction and operation of the "plunger actuated surface treating tool" of the present invention will be readily understood and further explanation is believed to be unnecessary. However, since numerous modifications and equivalents will readily occur to those skilled in the art, it is not desired to limit the invention to the exact construction and operation shown and described, and accordingly, all suitable embodiments and equivalents may be resorted to, falling within the scope of the appended claims.

We claim:

1. Surface-treating device having a selectable lower-end surface-impacting tool and which device extends directionally longitudinally along an uprightable central-axis and comprising:

(A) said surface-treating device having structurally-continuous relationship with a lower-end forward-extremity of a rearwardly tubular metallic forward-part surrounding said central-axis and having a rearward-end located above the forward-extremity of said tubular forward-part;

(B) a semi-resilient non-metallic tubular rearward-part surrounding said central-axis and having an annular lower forward-terminus located a finite-gap immediately rearwardly above said forward-part rearward-end and having an upper rearward-terminus located loftily above the said forward-terminus thereof;

(C) extending along said central-axis from said surface-impacting tool to said finite-gap and upwardly longitudinally beyond into the lower forward reaches of said tubular rearward-part and surrounded thereby, an upright non-metallic plug having rearward topical-end;

(D) means extending between said rearwardly tubular forward-part and said tubular rearward-part, means for maintaining a said finite-gap therebetween;

(E) extending along said central-axis and located immediately rearwardly of said non-metallic plug and loosely associated within said tubular rearward-part immediately rearwardly above said plug, a metallic shock-absorber members; and (F) extending along said central-axis surrounded by said tubular rearward-part and immediately rearwardly of said shock-absorber member at a lower forward aft-end thereof, a manually-actuatable elongate plunger member having an upper and rearward trail-end located loftily above the plunger member lower forward aft-end and loftily also rearwardly upwardly of the non-metallic tubular rearward-part rear-ward-terminus.

2. The surface-treating device of claim 1 wherein the tubular rearward-part substantially at the rearward-terminus thereof is provided with a resiliently-compressive manual-steadying means to accommodate the left-hand of a right-handed operator; and wherein the plunger member substantially at the upward trail-end thereof is provided with a manual-grasping means to accommodate the right-hand of a right-handed operator.

3. The surface-treating device of claim 2 wherein there is visually-opaque concealment means attached in surrounding relationship to upper rearward reaches of said metallic forward-part and to in surrounding relationship to lower forward reaches of said non-metallic rearward-part, to thereby visually conceal said finite-gap therebetween.

* * * * *